US009757763B2

(12) United States Patent
DiSiro et al.

(10) Patent No.: US 9,757,763 B2
(45) Date of Patent: Sep. 12, 2017

(54) SIDE BY SIDE CARTRIDGE ASSEMBLIES AND RELATED METHODS

(71) Applicant: Nordson Corporation, Westlake, OH (US)

(72) Inventors: Ernest DiSiro, Feasterville, PA (US); Dwayne J. Pulcine, Forked River, NJ (US); Robert W. Springhorn, Cream Ridge, NJ (US); Michael A. Vidal, North Attleborough, MA (US)

(73) Assignee: Nordson Corporation, Westlake, OH (US)

( * ) Notice: Subject to any disclaimer, the term of this patent is extended or adjusted under 35 U.S.C. 154(b) by 85 days.

(21) Appl. No.: 14/483,302

(22) Filed: Sep. 11, 2014

(65) Prior Publication Data

US 2015/0114995 A1 Apr. 30, 2015

Related U.S. Application Data

(60) Provisional application No. 61/897,912, filed on Oct. 31, 2013.

(51) Int. Cl.

| | |
|---|---|
| ***B67D 7/80*** | (2010.01) |
| ***B05C 17/005*** | (2006.01) |
| ***B05C 17/01*** | (2006.01) |

(52) U.S. Cl.

CPC .. *B05C 17/00516* (2013.01); *B05C 17/00513* (2013.01); *B05C 17/00553* (2013.01); *B05C 17/00596* (2013.01); *B05C 17/01* (2013.01)

(58) Field of Classification Search

CPC ..... B05C 17/00566; B05C 17/00553; B05C 17/00559; B05C 17/00563

USPC ... 222/145.5, 145.6, 325–328, 129, 132–142

See application file for complete search history.

(56) References Cited

U.S. PATENT DOCUMENTS

| | | | | |
|---|---|---|---|---|
| 2,382,304 A | | 8/1945 | Foltz et al. | |
| 4,493,436 A | | 1/1985 | Brokaw | |
| 4,690,306 A | | 9/1987 | Staheli | |
| 4,771,919 A | * | 9/1988 | Ernst | B65D 81/325 222/134 |

(Continued)

FOREIGN PATENT DOCUMENTS

| | | |
|---|---|---|
| DE | 910054 U1 | 4/1991 |
| DE | 4231420 A1 | 3/1994 |

(Continued)

OTHER PUBLICATIONS

European Patent Office, European Search Report in EP Application No. 14190844, dated Jun. 26, 2015.

*Primary Examiner* — Lien Ngo
(74) *Attorney, Agent, or Firm* — Baker & Hostetler LLP

(57) ABSTRACT

A side by side cartridge assembly for dispensing first and second fluid materials includes a first cartridge container and a second cartridge container. The cartridge containers include respective bodies and nozzle members coupled with the bodies. The cartridge containers are positionable with respect to one another such that the two nozzle members cooperate to form a cartridge outlet for dispensing first and second fluid materials from the respective bodies. The cartridge outlet includes dispensing openings communicating with respective nozzle channels, and a sealing surface configured for sealing engagement with a mixing element when a mixing element is attached to the cartridge outlet.

20 Claims, 10 Drawing Sheets

(56) References Cited

U.S. PATENT DOCUMENTS

| | | | | |
|---|---|---|---|---|
| 5,228,599 | A * | 7/1993 | Keller | B05C 17/00513 222/137 |
| 5,249,709 | A * | 10/1993 | Duckworth | B05C 17/00506 222/137 |
| 5,443,183 | A * | 8/1995 | Jacobsen | B05C 17/00513 222/137 |
| 5,449,096 | A | 9/1995 | Sedlmeier | |
| 5,480,067 | A | 1/1996 | Sedlmeier | |
| 5,535,922 | A | 7/1996 | Maziarz | |
| 5,540,356 | A | 7/1996 | Camm et al. | |
| 5,647,510 | A | 7/1997 | Keller | |
| 6,382,466 | B1 | 5/2002 | Schneider et al. | |
| 6,409,972 | B1 | 6/2002 | Chan | |
| 6,454,129 | B1 | 9/2002 | Green | |
| 6,634,524 | B1 | 10/2003 | Helmenstein | |
| 6,938,797 | B2 | 9/2005 | Brugner et al. | |
| 7,237,693 | B2 | 7/2007 | Brennan et al. | |
| 7,712,635 | B2 | 5/2010 | Kovac | |
| 7,748,567 | B2 | 7/2010 | Horner et al. | |
| 7,841,481 | B2 * | 11/2010 | Gleich | B65D 81/3288 215/6 |
| 8,544,683 | B2 | 10/2013 | Springhorn et al. | |
| 2005/0011853 | A1 * | 1/2005 | Brugger | B65D 81/3288 215/10 |
| 2008/0187253 | A1 | 8/2008 | Willner et al. | |
| 2009/0084815 | A1 | 4/2009 | Paetow et al. | |
| 2009/0134186 | A1 | 5/2009 | Keller | |
| 2009/0277926 | A1 | 11/2009 | Schell | |
| 2010/0163579 | A1 | 7/2010 | Keller | |
| 2011/0026359 | A1 * | 2/2011 | Ritter | B01F 5/0615 366/184 |

FOREIGN PATENT DOCUMENTS

| | | | |
|---|---|---|---|
| DE | 4327755 | A1 | 2/1995 |
| DE | 4335970 | A1 | 4/1995 |
| DE | 202013100344 | U1 | 2/2013 |
| EP | 0521434 | A1 | 1/1993 |
| EP | 0653362 | A1 | 5/1995 |
| EP | 2143662 | A1 | 1/2010 |
| FR | 2702396 | A1 | 9/1994 |
| GB | 1118355 | A | 7/1968 |
| GB | 2082686 | A | 3/1982 |
| GB | 2255596 | A | 11/1992 |
| JP | 2005289470 | A | 10/2005 |
| WO | 9105731 | A1 | 5/1991 |
| WO | 9301993 | A1 | 2/1993 |
| WO | 9509785 | A1 | 4/1995 |
| WO | 201356872 | A1 | 4/2013 |
| WO | 201356873 | A1 | 4/2013 |
| WO | 201356874 | A1 | 4/2013 |

* cited by examiner

SIDE BY SIDE CARTRIDGE ASSEMBLIES AND RELATED METHODS

CROSS-REFERENCE TO RELATED APPLICATION

This application claims the benefit of Application Ser. No. 61/897,912, filed Oct. 31, 2013, the disclosure of which is hereby incorporated by reference herein.

FIELD OF THE INVENTION

The present invention generally relates to multiple component dispensing and mixing cartridges having a side by side configuration.

BACKGROUND

Various types of multiple component dispensing and mixing devices exist, including those that use cartridges having fluid chambers in a side by side configuration, and those having fluid chambers in a coaxial configuration. Such cartridges are typically used in conjunction with handheld applicator or gun having one or more movable plungers. The plunger(s) move piston(s) associated with the fluid chambers to dispense the two component fluids at a distal end of the cartridge. The two component fluids can be mixed by a mixing device after being dispensed from the fluid chambers. For example, a mixing device can be attached to an outlet of a cartridge, and the two component fluids enter the mixing device after exiting the fluid chambers. Often, the two component fluids used in such cartridges include an adhesive material and an activator material for activating the adhesive material.

Known side by side cartridges include those having an essentially unitary body construction, with the body portions defining the respective fluid chambers being connected together and formed of a common material. Such cartridges present challenges with some component fluid materials, however, such as when the common material of the body portions is incompatible with or susceptible to permeation of one or more of the component fluids.

Known side by side cartridges also include those having separate body portions, with the body portions being brought together and joined to form a cartridge. Joining separate body portions in such a manner has presented challenges, however, relating to attaching a mixing device to the body portions. Particularly, the separate body portions each include a nozzle, and the nozzles are positioned next to one another to form an outlet of the cartridge. A mixing device is then attached to the respective nozzles forming the outlet of the cartridge. However, forming a fluid-tight seal between the cartridge outlet and the mixing device is made difficult by the fact that the mixing device must be both (1) attached to and (2) form a sealing engagement with the nozzles, which are separate components. Particularly, the junction of the two nozzles forms a seam where an incomplete seal may be formed when the mixing device is attached. Leaks may occur at the junction of the two nozzles, which can lead to waste of fluid materials and inconvenience for a user.

It would be desirable to provide a side by side cartridge and related methods that address the various problems and complications involved with current cartridges and methods.

SUMMARY

Embodiments of the invention are directed to side by side cartridge assemblies for dispensing first and second fluid materials, and methods of joining a first cartridge container with a second cartridge container to form a side by side cartridge assembly. The side by side cartridge assemblies include a cartridge outlet having an uninterrupted sealing surface for sealing with a mixing element when a mixing element is attached to the cartridge outlet. The sealing surface is devoid of seams or other discontinuities and improves the seal formed between the cartridge outlet and the mixing element.

According to one embodiment of the invention, a side by side cartridge assembly is provided for dispensing first and second fluid materials. The side by side cartridge assembly includes a first cartridge container having a first body configured to contain a supply of the first fluid material and a first nozzle member coupled with the first body. The first nozzle member has a first nozzle channel configured to communicate with the supply of the first fluid material. The side by side cartridge assembly further includes a second cartridge container having a second body configured to contain a supply of the second fluid material and a second nozzle member coupled with the second body. The second nozzle member has a second nozzle channel configured to communicate with the supply of the second fluid material. The first cartridge container and the second cartridge container are positionable with respect to one another such that the first nozzle member and the second nozzle member cooperate to form a cartridge outlet for dispensing the first and second fluid materials. The cartridge outlet includes a first dispensing opening communicating with the first nozzle channel and a second dispensing opening communicating with the second nozzle channel. The cartridge outlet further includes an uninterrupted sealing surface surrounding the first and second dispensing openings and configured for sealing engagement with a mixing element when a mixing element is attached to the cartridge outlet.

According to another embodiment of the invention, a side by side cartridge assembly is provided for dispensing first and second fluid materials. The side by side cartridge assembly includes a first cartridge container having a first body configured to contain a supply of the first fluid material and a first nozzle member coupled with the first body. The first nozzle member has a first nozzle channel configured to communicate with the supply of the first fluid material, and a receiving bore. The second cartridge container has a second body configured to contain a supply of the second fluid material and a second nozzle member coupled with the second body. The second nozzle member has a second nozzle channel configured to communicate with the supply of the second fluid material and a stem configured to fit within the receiving bore. The first cartridge container and the second cartridge container are positionable with respect to one another such that the first nozzle member and the second nozzle member cooperate with the stem of the second nozzle member received in the receiving bore of the first nozzle member to form a cartridge outlet for dispensing the first and second fluid materials. The cartridge outlet includes a first dispensing opening communicating with the first nozzle channel and a second dispensing opening communicating with the second nozzle channel. The cartridge outlet further includes an uninterrupted sealing surface formed on the first nozzle member and surrounding the first and second dispensing openings and configured for sealing engagement with a mixing element when a mixing element is attached to the cartridge outlet.

According to another embodiment of the invention, a side by side cartridge assembly is provided for dispensing first and second fluid materials. The side by side cartridge assembly includes a first cartridge container having a first body configured to contain a supply of the first fluid material and a first nozzle member coupled with the first body. The first nozzle member has a first nozzle channel configured to communicate with the supply of the first fluid material. The second cartridge container has a second body configured to contain a supply of the second fluid material and a second nozzle member coupled with the second body. The second nozzle member has a second nozzle channel configured to communicate with the supply of the second fluid material. The first cartridge container and the second cartridge container extend between respective dispensing ends and back ends, and the first and second nozzle members are located proximate to the dispensing ends. A slot is formed in one of the first and second bodies proximate to the back end. In addition, a t-shaped tab is formed in the other of the first and second bodies proximate to the back end. The t-shaped tab fits into the slot to secure the back end of the first cartridge container with the back end of the second cartridge container when the first nozzle member and the second nozzle member are positioned to form a cartridge outlet. The cartridge outlet includes a first dispensing opening communicating with the first nozzle channel and a second dispensing opening communicating with the second nozzle channel. The cartridge outlet further includes a sealing surface configured for sealing engagement with a mixing element when a mixing element is attached to the cartridge outlet.

According to another embodiment of the invention, a side by side cartridge assembly is provided for dispensing first and second fluid materials. The side by side cartridge assembly includes a first cartridge container having a first body configured to contain a supply of the first fluid material and a first nozzle member coupled with the first body. The first nozzle member has a first nozzle channel configured to communicate with the supply of the first fluid material. The second cartridge container has a second body configured to contain a supply of the second fluid material and a second nozzle member coupled with the second body. The second nozzle member has a second nozzle channel configured to communicate with the supply of the second fluid material. The first cartridge container and the second cartridge container are positionable with respect to one another such that the first nozzle member and the second nozzle member cooperate to form a cartridge outlet for dispensing the first and second fluid materials. The cartridge outlet includes a first dispensing opening communicating with the first nozzle channel and a second dispensing opening communicating with the second nozzle channel. The first cartridge container is formed from a first cartridge material and the second cartridge container is formed from a second cartridge material. The first cartridge material is configured to be compatible with the first fluid material, and the second cartridge material is configured to be compatible with the second fluid material. Thereby, the first and second cartridge materials inhibit permeation of the first and second fluid materials within the respective first and second cartridge containers.

According to another embodiment of the invention, a method is provided for joining a first cartridge container and a second cartridge container to form a side by side cartridge assembly for dispensing first and second fluid materials. The first cartridge container has a first body configured to contain a supply of the first fluid material and a first nozzle member coupled with the first body. The first nozzle member has a first nozzle channel configured to communicate with the supply of the first fluid material, and a receiving bore. The second cartridge container has a second body configured to contain a supply of the second fluid material and a second nozzle member coupled with the second body. The second nozzle member has a second nozzle channel configured to communicate with the supply of the second fluid material, and a stem. The method includes positioning the stem of the second nozzle member into the receiving bore of the first nozzle member, and forming a cartridge outlet for dispensing the first and second fluid materials. The cartridge outlet includes a first dispensing opening communicating with the first nozzle channel and a second dispensing opening communicating with the second nozzle channel. The cartridge outlet further includes an uninterrupted sealing surface surrounding the first and second dispensing openings and configured for sealing engagement with a mixing element when a mixing element is attached to the cartridge outlet.

Various additional features and advantages of the invention will become more apparent to those of ordinary skill in the art upon review of the following detailed description of the illustrative embodiments taken in conjunction with the accompanying drawings.

DETAILED DESCRIPTION

Figure 1:
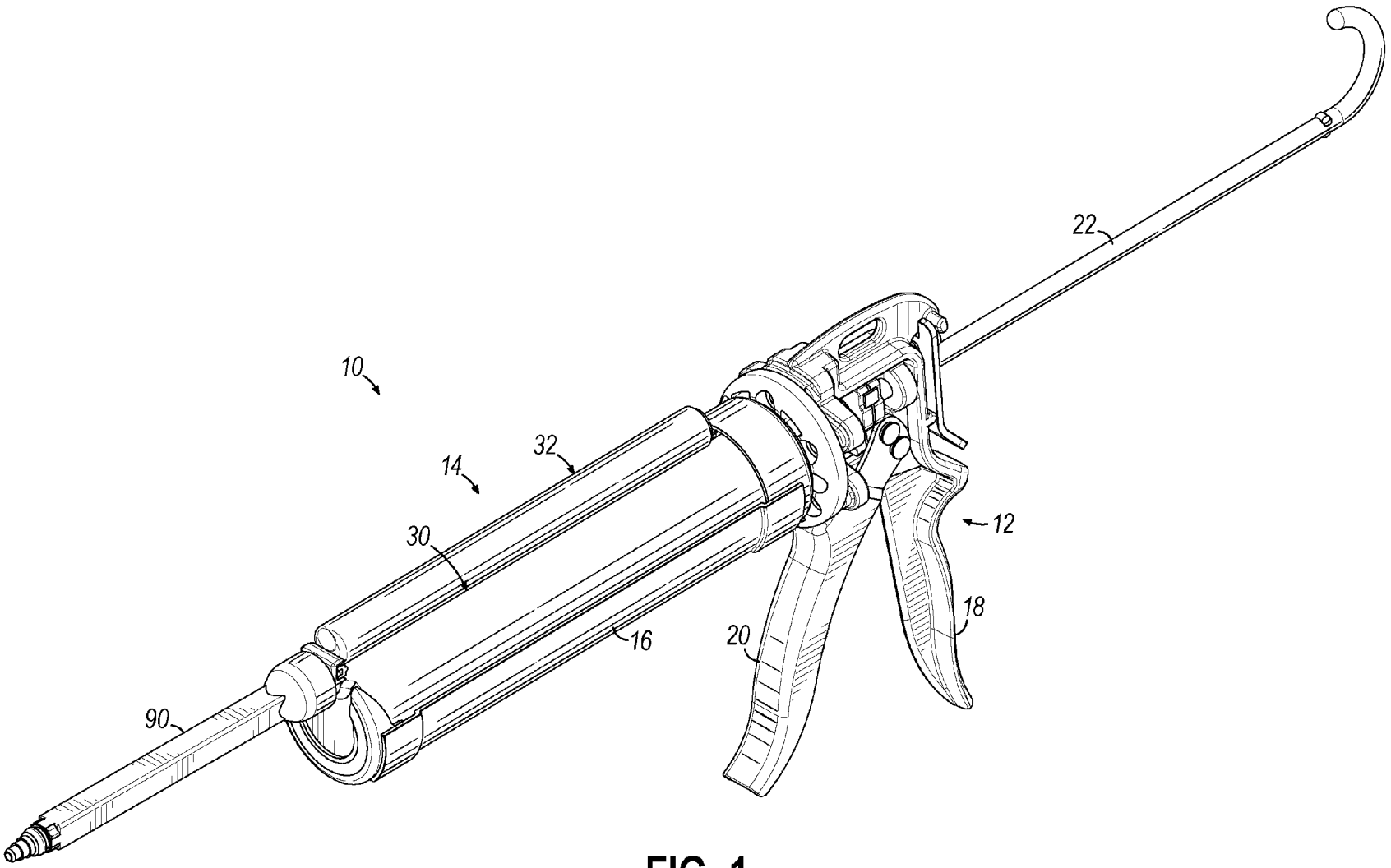
FIG. 1 is an isometric view showing a multiple component dispensing assembly including a dispensing gun and a side by side cartridge assembly constructed according to an embodiment of the present invention.

Referring to the figures, various side by side cartridge assemblies are shown which are usable with a dispensing gun for dispensing multiple component fluid materials. For example, and as shown in FIG. 1, an exemplary dispensing applicator assembly 10 includes a dispensing gun 12 and a side by side cartridge assembly 14. The dispensing gun 12 includes a cradle 16 for holding the cartridge assembly 14, and a handle 18 for a user to grasp. The dispensing gun 12 further includes a trigger 20 that is squeezed by a user to advance a drive rod 22. The drive rod 22 advances a piston assembly, such as a piston assembly 54 shown in FIG. 3 and discussed below in greater detail with respect to U.S. Pat. No. 8,544,683. As such, the drive rod 22 operatively engages the cartridge assembly 14 to cause fluid components of the cartridge assembly 14 to be dispensed. Another side by side cartridge assembly 24 is shown in FIGS. 7-10 and is usable with the dispensing gun 12 in a similar manner as the cartridge assembly 14.

The cartridge assembly 14 will now be described with reference to FIGS. 2-6. The cartridge assembly 14 generally includes a first cartridge container 30 and a second cartridge container 32. The cartridge containers 30, 32 are separate objects that are brought together to form the cartridge assembly 14. While the cartridge containers 30, 32 shown in the figures have different sizes, it will be appreciated that the cartridge containers 30, 32 can have any size, including the same size.

The first cartridge container 30 includes a body 34 configured to contain a supply of a first fluid material. The body 34 is generally cylindrical and a fluid reservoir 36 (FIGS. 4 and 5) is formed within the body 34. The first fluid material resides in the fluid reservoir 36 when the first fluid material is added to the body 34. A nozzle member 38 is coupled with the body 34 and includes a nozzle channel 40 that is configured to communicate with the fluid reservoir 36 and a supply of first fluid material that may be contained therein. An end plug 42 (FIG. 3) is positioned in the body 34 generally opposite the nozzle member 38 and partially defines the fluid reservoir 36. The end plug 42 may be moved toward the nozzle member 38 to cause the first fluid material to move from the fluid reservoir 36 into, and out of, the nozzle channel 40.

The second cartridge container 32 includes a body 44 configured to contain a supply of a second fluid material. The body 44 is generally cylindrical and a fluid reservoir 46 (FIGS. 4 and 5) is formed within the body 44. The second fluid material resides in the fluid reservoir 46 when the second fluid material is added to the body 44. A nozzle member 48 is coupled with the body 44 and includes a nozzle channel 50 that is configured to communicate with the fluid reservoir 46 and a supply of second fluid material that may be contained therein. An end plug 52 (FIG. 3) is positioned in the body 44 generally opposite the nozzle member 48 and partially defines the fluid reservoir 46. The end plug 52 may be moved toward the nozzle member 48 to cause the second fluid material to move from the fluid reservoir 46 into, and out of, the nozzle channel 50.

Advantageously, the cartridge containers 30, 32 may be formed of, or have components formed of, any suitable material. For example, the cartridge containers 30, 32 can have components formed of materials that are compatible with the respective first and second fluid materials. In some embodiments, the cartridge containers 30, 32 can have components formed of different materials.

In addition, and by way of example only, the cartridge containers 30, 32 may be used with a piston assembly 54 having a first piston element 56 and a second piston element 58, as described in U.S. Pat. No. 8,544,683, the content of which is incorporated by reference herein in its entirety. The drive rod 22 of the dispensing gun 12 engages the piston assembly 54 (FIGS. 1 and 3), which in turn engages the end plugs 42, 52 to move the end plugs 42, 52 to cause the first and second fluid materials to move from the fluid reservoir 36, 46 into, and out of, the nozzle channels 40, 50.

The first cartridge container 30 and the second cartridge container 32 may be brought together and positioned with respect to one another such that the nozzle members 38, 48 of the respective cartridge container 30, 32 form a cartridge outlet 60 for dispensing the first and second fluid materials.

Figure 4:
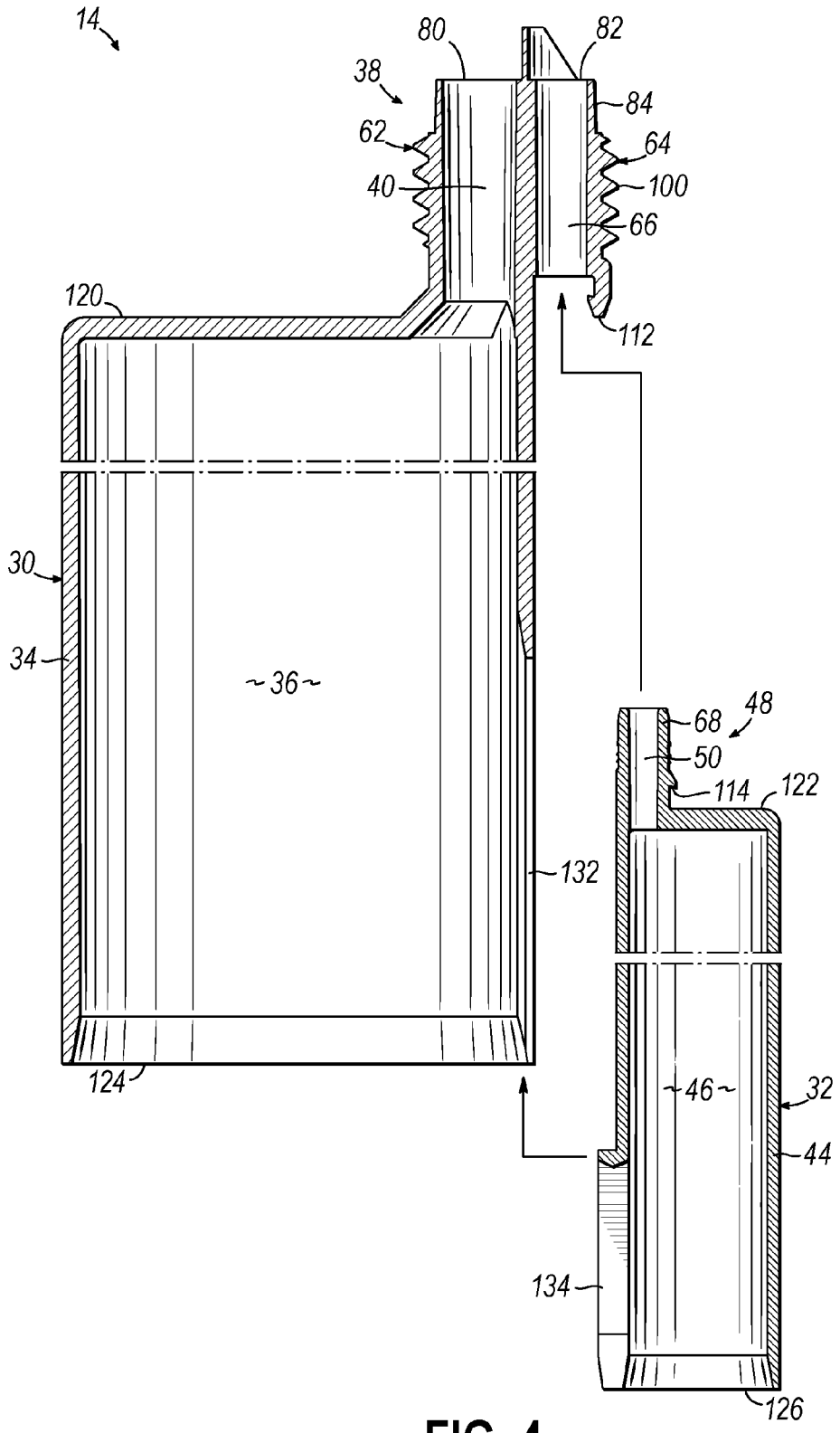
FIG. 4 is a longitudinal cross section disassembled view showing a first cartridge container separated from a second cartridge container of the side by side cartridge assembly of FIG. 2.
Figure 5:
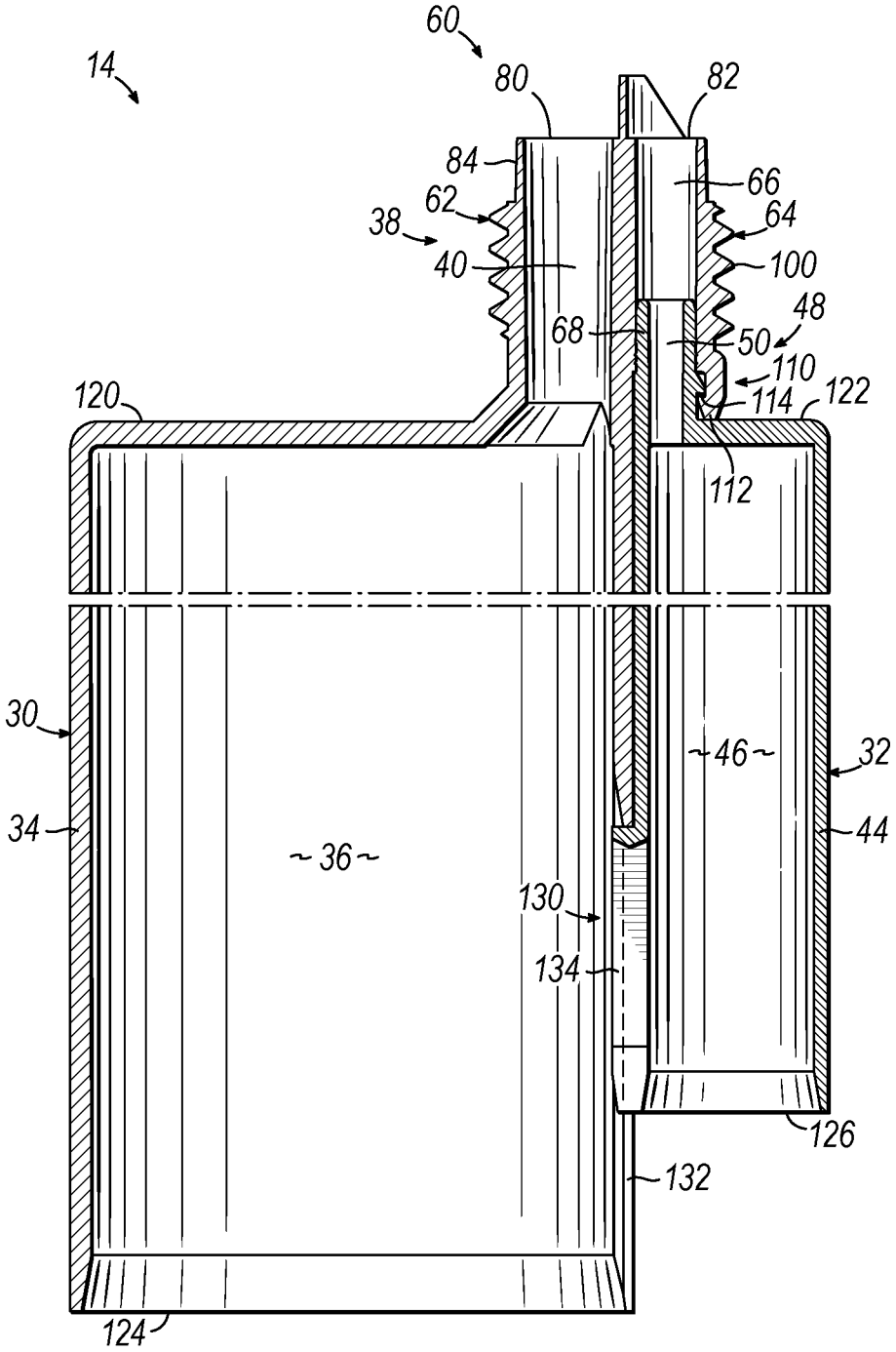
FIG. 5 is a longitudinal cross section view like FIG. 4, but showing the first cartridge container secured with the second cartridge container, and nozzles of the respective cartridge containers together forming a cartridge outlet.
Figure 6:
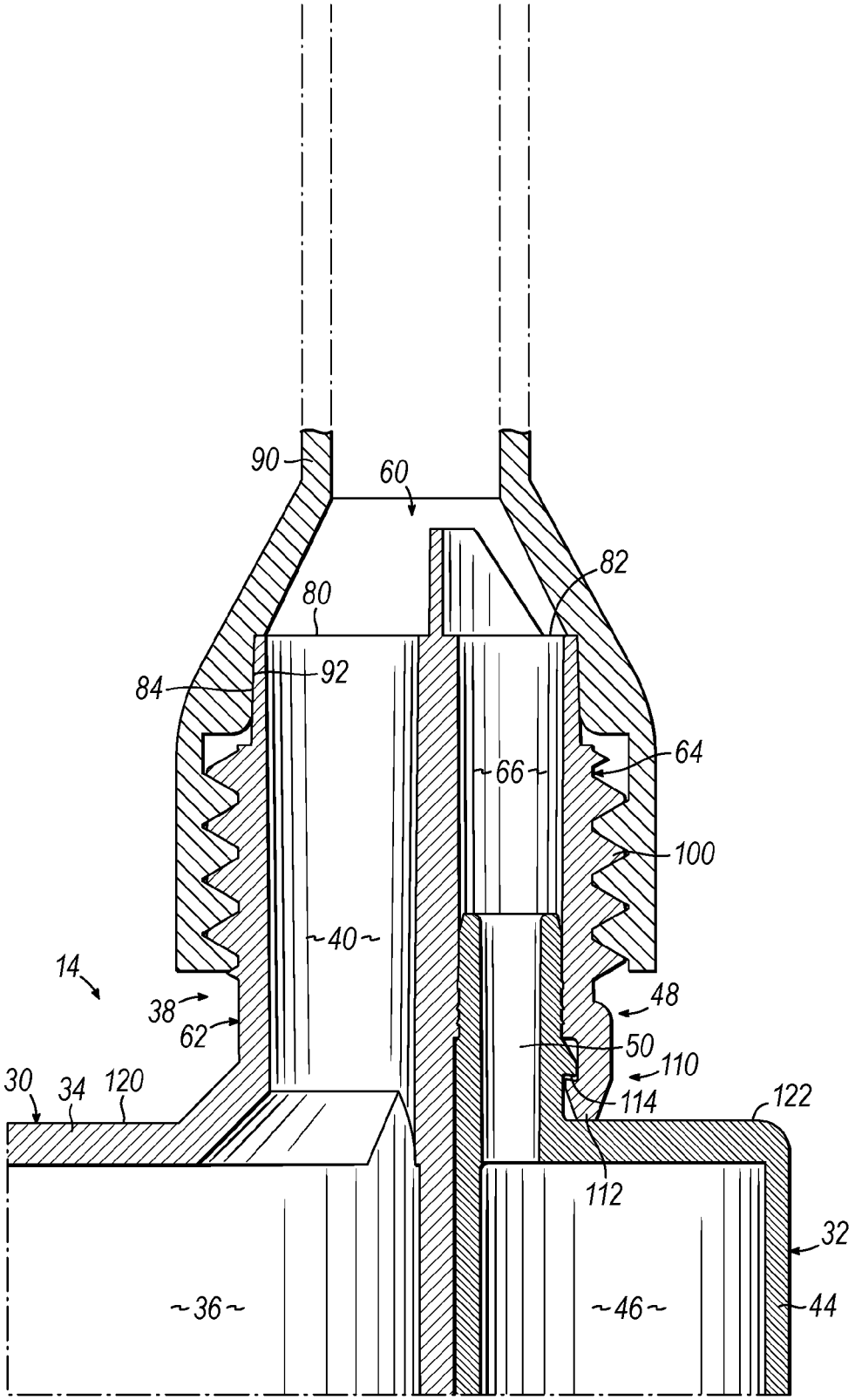
FIG. 6 is an enlarged view showing a portion of FIG. 5, with a mixing element attached to the cartridge outlet.
Figure 7:
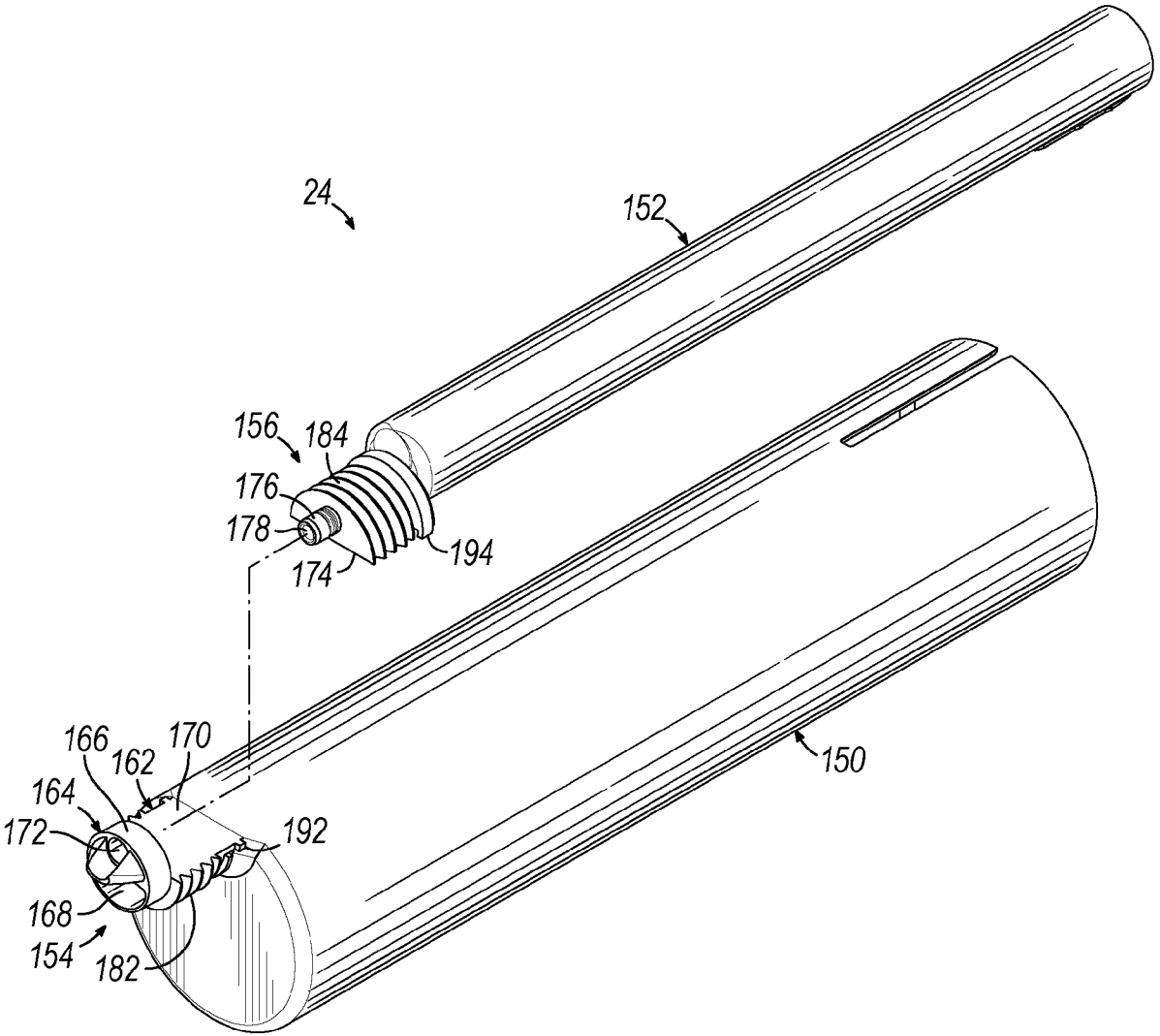
FIG. 7 is an isometric disassembled view showing a side by side cartridge assembly constructed according to another embodiment of the present invention, with a first cartridge container separated from a second cartridge container.

In particular, the nozzle member 38 of the first cartridge container 30 has a generally cylindrical shape and includes a first part 62 and a second part 64 (FIGS. 4-6). The first part 62 is generally laterally within the footprint defined by the outer wall of the body 34, and includes the nozzle channel 40. The second part 64 is generally laterally outside the footprint defined by the outer wall of the body 34, and includes a receiving bore 66.

The nozzle member 48 of the second cartridge container 32 includes a stem 68, and the nozzle channel 50 extends in the stem 68. The receiving bore 66 of the nozzle member 38 and the stem 68 of the nozzle member 48 are configured such that the stem 68 is positioned into the receiving bore 66 (FIGS. 4 and 5) when the nozzle members 38, 48 are brought together to form the cartridge outlet 60.

The cartridge outlet 60 includes a first dispensing opening 80 and a second dispensing opening 82 for dispensing the first and second fluids, respectively. The first dispensing opening 80 communicates with the nozzle channel 40 of the first cartridge container 30, and the second dispensing opening 82 communicates with the nozzle channel 50 of the second cartridge container 32. The cartridge outlet 60 further includes an uninterrupted sealing surface 84 that surrounds the first and second dispensing openings 80, 82. The sealing surface 84 is devoid of seams or other discontinuities.

The sealing surface 84 is configured for sealing engagement with a mixing element 90 (FIGS. 1 and 6) when the mixing element 90 is secured or attached to the cartridge outlet 60. Particularly, the mixing element 90 includes an internal surface 92 that is put into sealing engagement with the sealing surface 84 of the cartridge outlet 60 when the mixing element 90 is attached thereto. By being uninterrupted and devoid of seams or other discontinuities, the sealing surface 84 provides an improved seal between the cartridge outlet 60 and the mixing element 90.

The sealing surface 84 is provided on the nozzle member 38 of the first cartridge container 30, and is included on both parts 62, 64 of the nozzle member 38.

In the embodiment shown, the stem 68 of the nozzle member 48 terminates at an intermediate position within the receiving bore 66 and does not reach the dispensing opening 82 of the cartridge outlet 60 (FIG. 5) when the nozzle members 38, 48 are brought together to form the cartridge outlet 60. In another configuration, the stem 68 can have a length such that it extends to the second dispensing opening 82 of the cartridge outlet 60 when the nozzle members 38, 48 are brought together to form the cartridge outlet 60.

The cartridge outlet 60 also includes a threaded portion 100 that is configured for threadably securing the mixing element 90 to the cartridge outlet 60. The threaded portion 100 is positioned rearwardly of the sealing surface 84, such that the sealing surface 84 is situated between the threaded portion 100 and the first and second dispensing openings 80, 82. As the mixing element 90 is threaded onto the threaded portion 100, the internal surface 92 of the mixing element 90 slides onto the sealing surface 84 of the cartridge outlet 60 (FIG. 6) and forms a sealed connection therewith.

Figure 2:
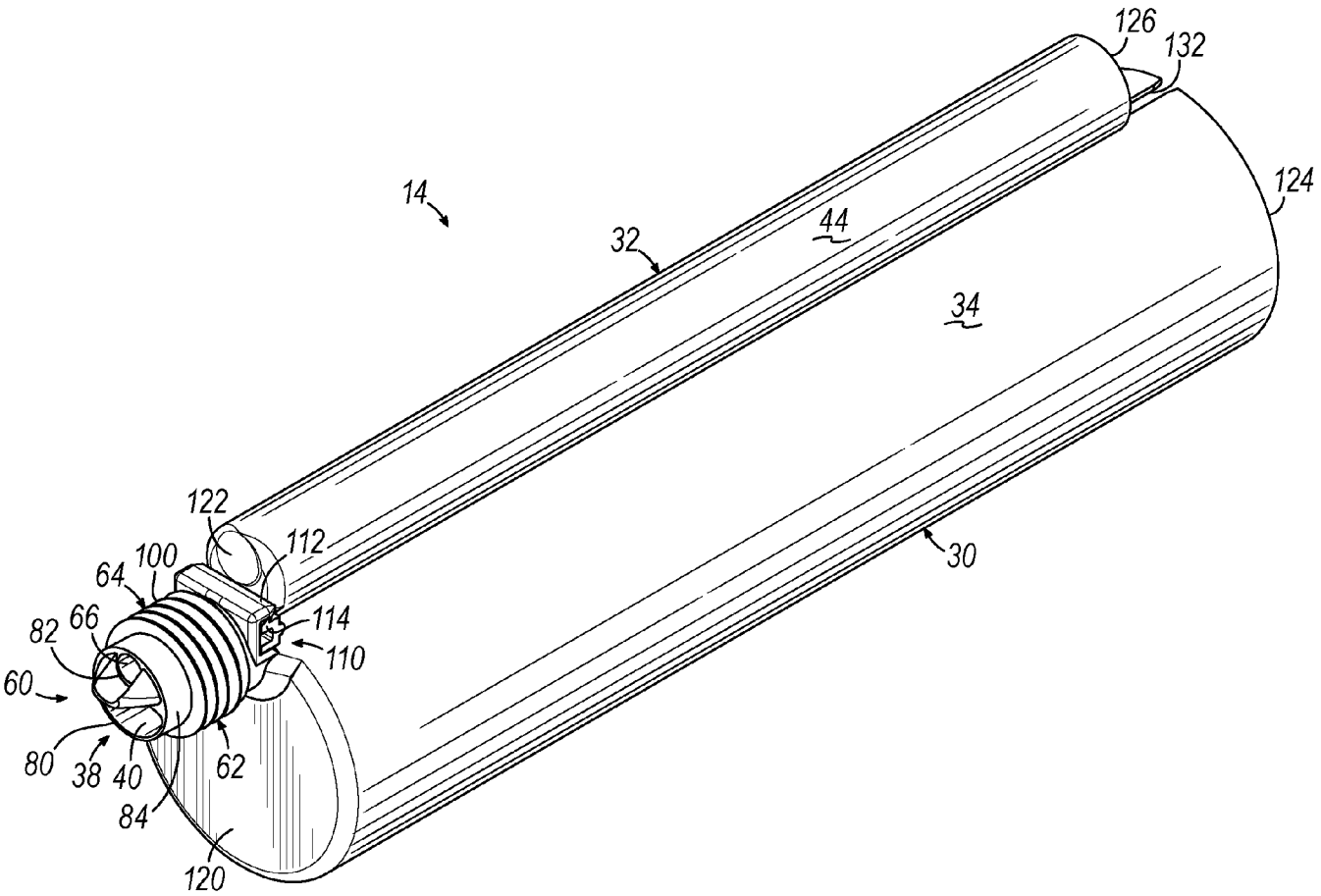
FIG. 2 is an isometric view showing the side by side cartridge assembly of FIG. 1.
Figure 3:
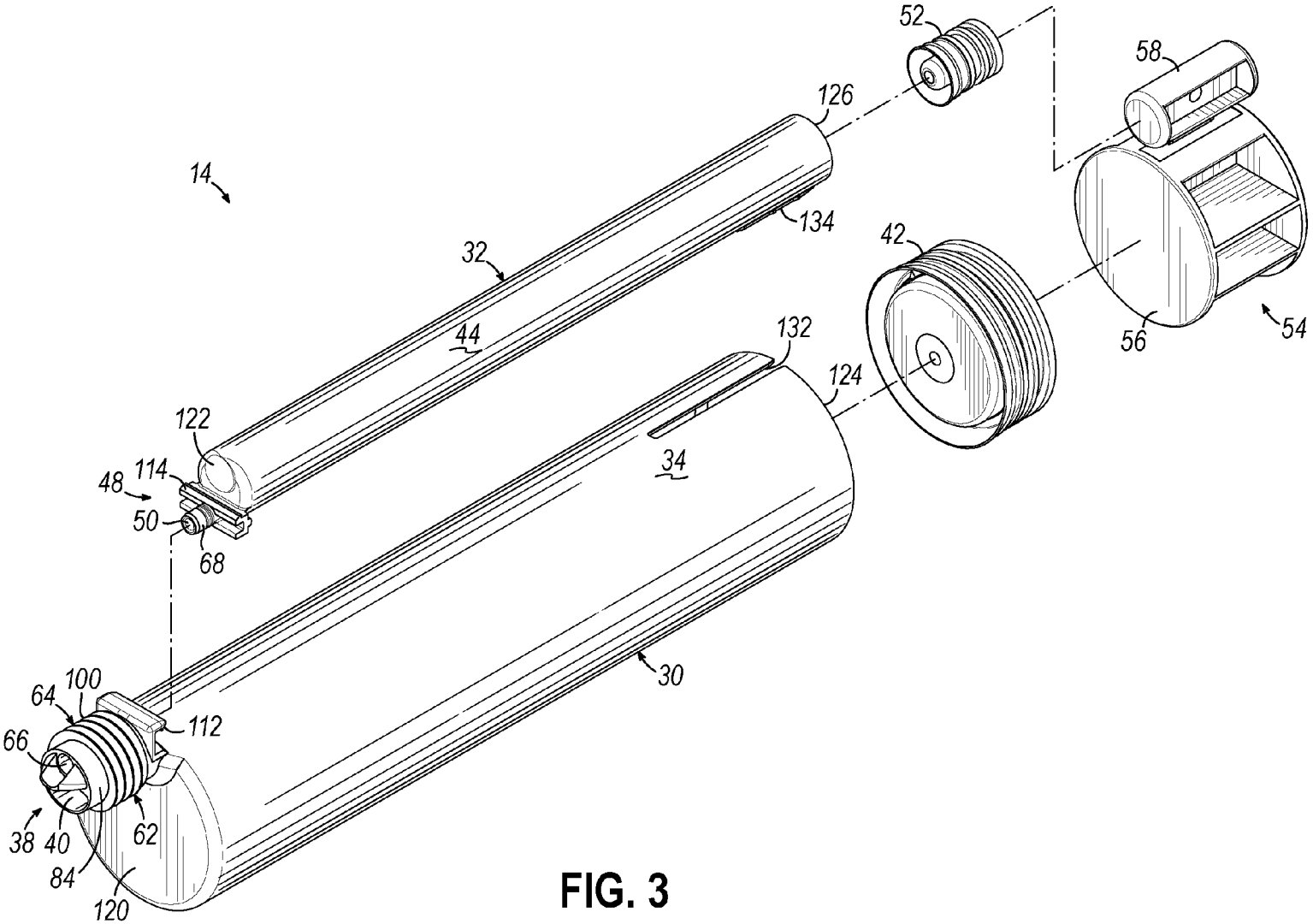
FIG. 3 is an isometric disassembled view showing the side by side cartridge assembly of FIG. 2.

In the embodiment shown in FIGS. 1-6, the entire threaded portion 100 is defined on the nozzle member 38 of the first cartridge container 30 (FIG. 3). The threaded portion 100 is included on both parts 62, 64 of the nozzle member 38. When the mixing element 90 is threaded onto the cartridge outlet 60, it is threaded onto the nozzle member 38 of the first cartridge container 30.

The cartridge assembly 14 further includes a retaining element 110 for securing the first cartridge container 30 and the second cartridge container 32. The retaining element 110 includes a latch 112 formed on the nozzle member 38 of the first cartridge container 30 and an undercut 114 formed on the nozzle member 48 of the second cartridge container 32 (FIGS. 4 and 5). The latch 112 and the undercut 114 cooperate to secure the first cartridge container 30 with the second cartridge container 32 when the nozzle members 38, 48 are brought together to form the cartridge outlet 60.

Figure 11:
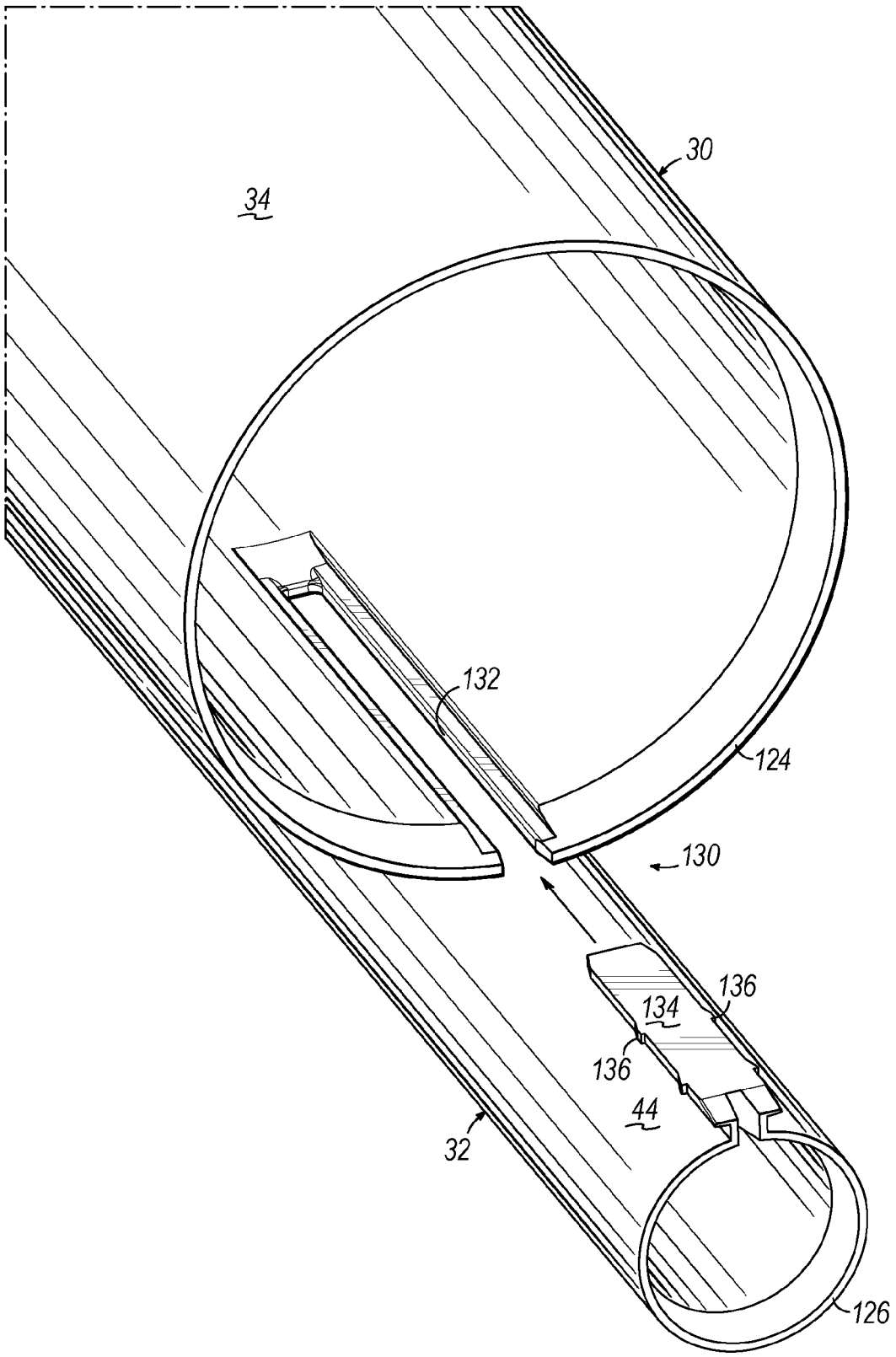
FIG. 11 is an isometric disassembled view showing a back end of a side by side cartridge assembly and a retaining element including a slot and a t-shaped tab for securing a first cartridge container with respect to a second cartridge container.
Figure 12:
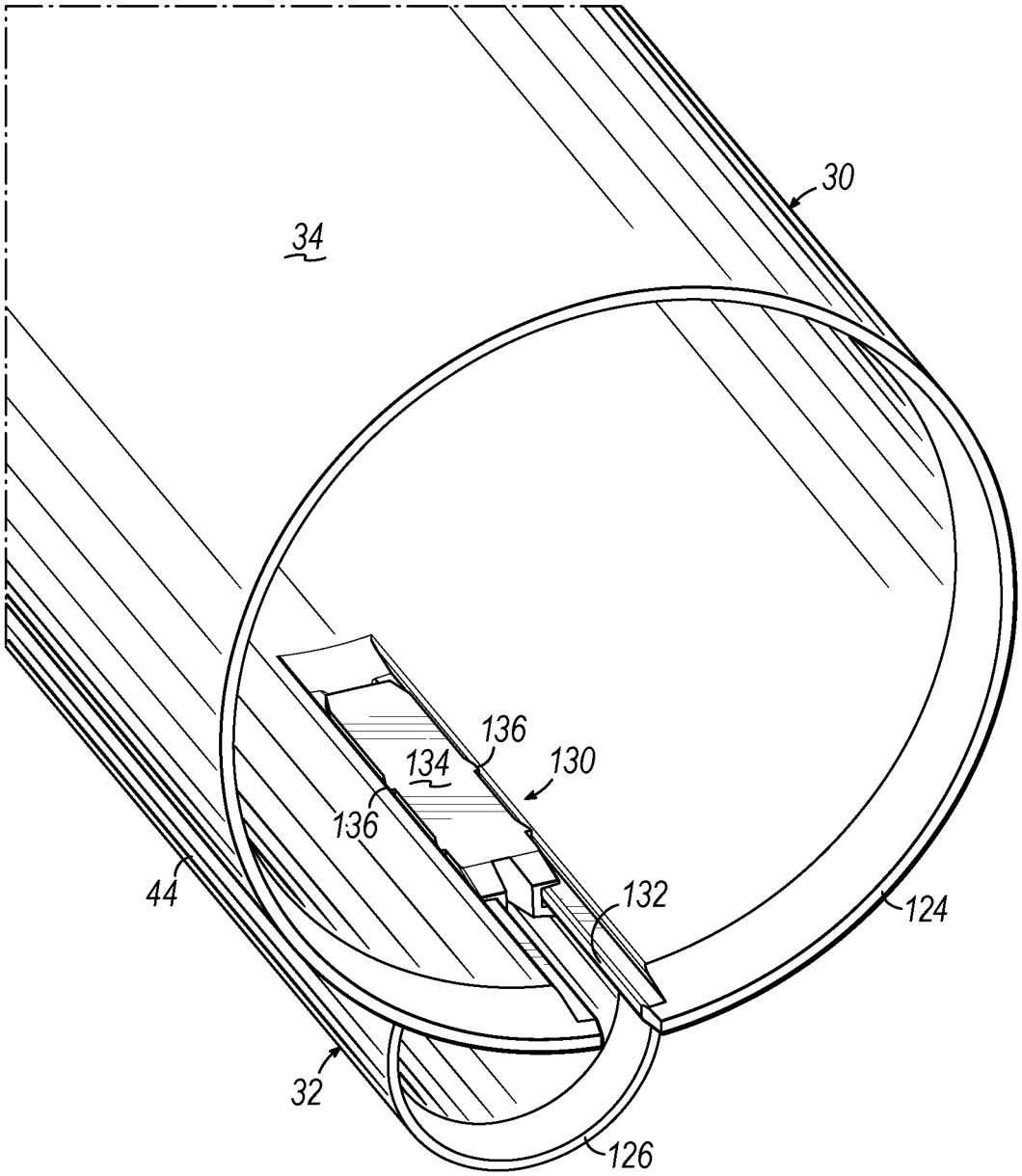
FIG. 12 is an isometric view like FIG. 11, but showing the tab received in the slot for securing the first cartridge container and the second cartridge container together.

The first cartridge container 30 and second cartridge container 32 generally extend between respective dispensing ends 120, 122 and back ends 124, 126 with the respective nozzle members 38, 48 located proximate the dispensing ends 120, 122 (FIGS. 2 and 3). The retaining element 110 secures the dispensing ends 120, 122 when the nozzle members 38, 48 are brought together to form the cartridge outlet 60. In addition, the cartridge assembly 14 can include another retaining element 130 (FIGS. 2, 11, and 12) for securing the back ends 124, 126 when the first cartridge container 30 and the second cartridge container 32, and their respective nozzle members 38, 48, are brought together to form the cartridge outlet 60.

In particular, the retaining element 130 includes a lengthwise extending slot 132 formed in the body 34 of the first cartridge container 30, and a t-shaped tab 134 formed in the body 44 of the second cartridge container 32. The t-shaped tab 134 fits into the slot 132 to secure the back ends 124 of the first cartridge container 30 with the back end 126 of the second cartridge container 32 when the first cartridge container 30 and the second cartridge container 32 are brought together to form the cartridge outlet 60. Optionally, the t-shaped tab 134 can include a plurality of barbs 136 for engaging the slot 132 and for preventing the t-shaped tab 134 from being removed from the slot 132.

In some embodiments, the cartridge assembly 14 can include both the retaining element 110 and the retaining element 130 for securing the first cartridge container 30 and the second cartridge container 32 at both the dispensing ends 120, 122 and the back ends 124, 126.

Figure 9:
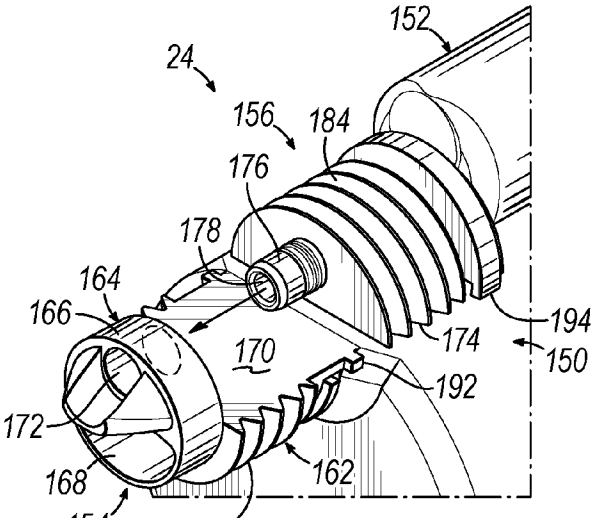
FIG. 9 is an isometric view showing nozzles of the first cartridge container and the second cartridge container of the side by side cartridge assembly of FIG. 7 being positioned with respect to one another.
Figure 8:
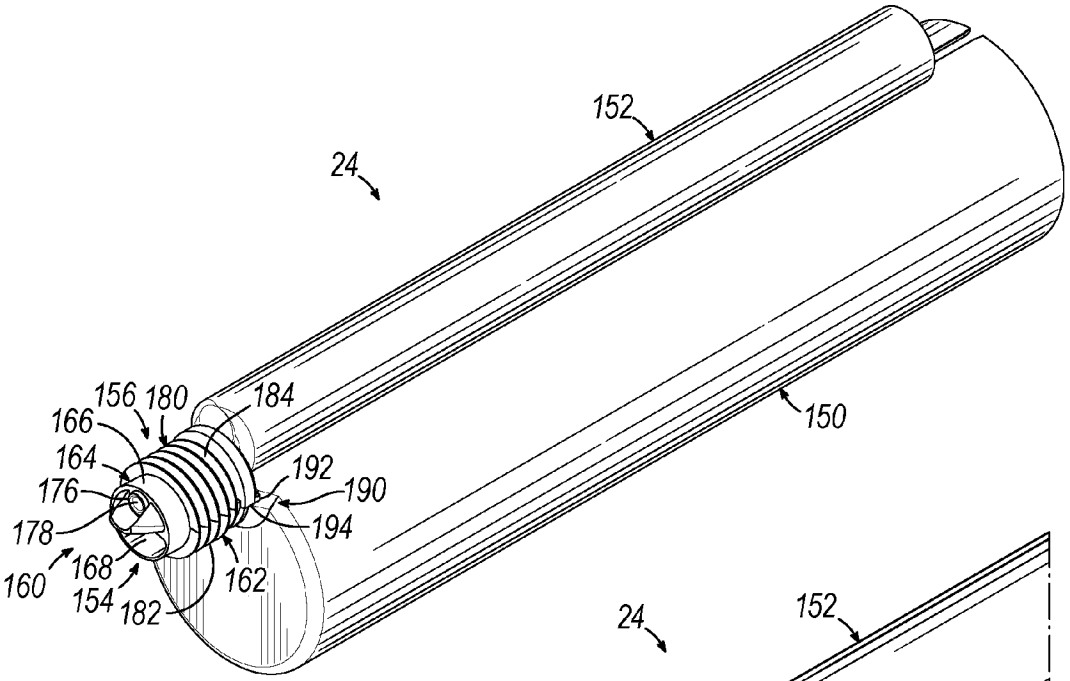
FIG. 8 an isometric view like FIG. 7, but showing the first cartridge container secured with the second cartridge container.
Figure 10:
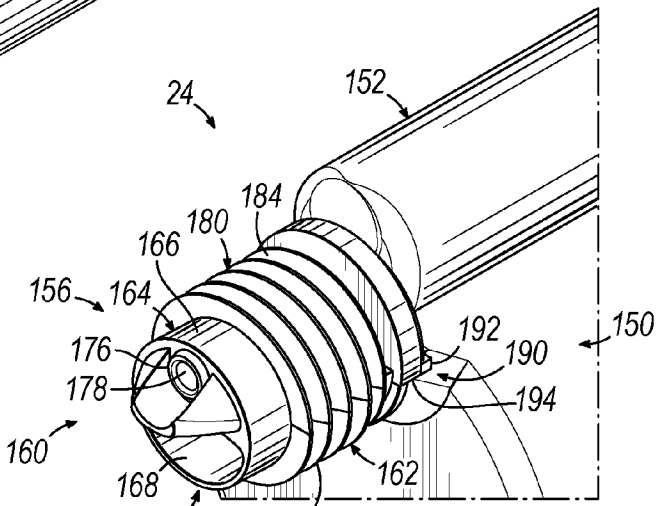
FIG. 10 is an isometric view like FIG. 9, but showing the first cartridge container secured with the second cartridge container, with the nozzles of the respective cartridge containers together forming a cartridge outlet.

Turning next to FIGS. 7-10, the side by side cartridge assembly 24 is further described. The cartridge assembly 24 is generally similar to the cartridge assembly 14, other than the nozzle members. Particularly, the cartridge assembly 24 includes a first cartridge container 150 and a second cartridge container 152 having respective nozzle members 154, 156. The nozzle members 154, 156 are brought together to form a cartridge outlet 160 (FIG. 10).

The nozzle member 154 of the first cartridge container 150 includes a generally semi-cylindrical shaped first portion 162 and a generally cylindrical shaped second portion 164. The second portion 164 includes an uninterrupted sealing surface 166. A nozzle channel 168 extends through the first and second portions 162, 164 and is configured to communicate with a fluid reservoir of the first cartridge container 150 and a supply of first fluid material that may be contained therein. The first portion includes a flat surface portion 170, and the second portion 164 includes a receiving bore 172.

The nozzle member 156 of the second cartridge container 152 includes a flat surface portion 174 that is put into confronting relationship with the flat surface portion 170 of the nozzle member 154 when the nozzle members 154, 156 are brought together to form the cartridge outlet 160 (FIGS. 9 and 10). The nozzle member 156 also includes a stem 176 that is configured to be received in the receiving bore 172 of the nozzle member 154 when the nozzle members 154, 156 are brought together to form the cartridge outlet 160. A nozzle channel 178 extends in the stem 176 and is configured to communicate with a fluid reservoir of the second cartridge container 152 and a supply of second fluid material that may be contained therein.

The cartridge outlet 160 includes a threaded portion 180 that is configured for threadably securing a mixing element to the cartridge outlet 160. The threaded portion 180 is defined by a first threaded region 182 on the nozzle member 154 and a second threaded region 184 on the nozzle member 156. A mixing element is threaded onto the threaded portion 180 by threading the mixing element onto nozzle member 154 and the nozzle member 156 when those nozzle members 154, 156 are brought together to form the cartridge outlet 160.

The cartridge assembly 24 further includes a retaining element 190 for securing the first cartridge container 150 and the second cartridge container 152. The retaining element 190 includes a latch 192 formed on the nozzle member 154 of the first cartridge container 150 and a protrusion 194 formed on the nozzle member 156 of the second cartridge container 152 (FIG. 9). The latch 192 and the protrusion 194 cooperate to secure the first cartridge container 150 with the second cartridge container 152 when the nozzle members 154, 156 are brought together to form the cartridge outlet 160.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A side by side cartridge assembly for dispensing first and second fluid materials, the assembly comprising:

a first cartridge container having a first body configured to contain a supply of the first fluid material and a first nozzle member coupled with the first body and having a first nozzle channel configured to communicate with the supply of the first fluid material, a second cartridge container having a second body configured to contain a supply of the second fluid material and a second nozzle member coupled with the second body and having a second nozzle channel configured to communicate with the supply of the second fluid material, the second cartridge container being positioned adjacent to the first cartridge container, and a latch formed in one of the first and second nozzle members and a receiver configured to receive the latch formed in the other of the first and second nozzle members, the first cartridge container and the second cartridge container being positionable with respect to one another such that the first nozzle member and the second nozzle member cooperate to form a cartridge outlet for dispensing the first and second fluid materials, the cartridge outlet including a first dispensing opening communicating with the first nozzle channel and a second dispensing opening communicating with the second nozzle channel, a threaded portion configured for threadably securing a mixing element to the cartridge outlet, and an uninterrupted sealing surface surrounding the first and second dispensing openings, the sealing surface being situated between the threaded portion and the first and second dispensing openings and configured for sealing engagement with a mixing element when the mixing element is attached to the cartridge outlet, wherein the first nozzle member includes the uninterrupted sealing surface, the latch and the receiver cooperating to secure the first cartridge container with the second cartridge container when the first nozzle member and second nozzle member are positioned to form the cartridge outlet, and the threaded portion of the cartridge outlet being defined by a first threaded region on the first nozzle member and a second threaded region on the second nozzle member.

2. The side by side cartridge assembly of claim 1, further comprising the mixing element secured to the cartridge outlet and including a mixing element surface in sealing engagement with the sealing surface of the cartridge outlet.

3. The side by side cartridge assembly of claim 1, wherein the first nozzle member further includes a receiving bore and the second nozzle member further includes a stem configured to fit within the receiving bore, the second nozzle channel extending in the stem.

4. The side by side cartridge assembly of claim 3, wherein the stem extends to the second dispensing opening when the first nozzle member and second nozzle member are positioned to form the cartridge outlet.

5. The side by side cartridge assembly of claim 1, wherein the first cartridge container and the second cartridge container extend between respective dispensing ends and back ends, the first and second nozzle members being located proximate the dispensing ends, and further comprising a slot formed in one of the first and second bodies proximate the back end thereof and a t-shaped tab formed in the other of the first and second bodies proximate the back end thereof, the t-shaped tab fitting into the slot to secure the back end of the first cartridge container with the back end of the second cartridge container when the first nozzle member and second nozzle member are positioned to form the cartridge outlet.

6. The side by side cartridge assembly of claim 5, the t-shaped tab including a plurality of barbs for engaging the slot and for preventing the t-shaped tab from being removed from the slot.

7. The side by side cartridge assembly of claim 5, further comprising a retaining element for securing the dispensing ends of the first cartridge container and the second cartridge container when the first nozzle member and second nozzle member are positioned to form the cartridge outlet.

8. The side by side cartridge assembly of claim 1, wherein the entire threaded portion of the cartridge outlet is defined on the first nozzle member.

9. The side by side cartridge assembly of claim 8, wherein the receiver is an undercut formed in the other of the first and second nozzle members.

10. The side by side cartridge assembly of claim 1, wherein the first nozzle member further includes a first flat surface portion and the second nozzle member further includes a second flat surface portion, the first and second flat surface portions being in confronting relationship when the first nozzle member and second nozzle member are positioned to form the cartridge outlet.

11. The side by side cartridge assembly of claim 1, wherein the receiver is a protrusion formed in the other of the first and second nozzle members.

12. A side by side cartridge assembly for dispensing first and second fluid materials, the assembly comprising:

a first cartridge container having a first body configured to contain a supply of the first fluid material and a first nozzle member coupled with the first body and having a first nozzle channel configured to communicate with the supply of the first fluid material, the first nozzle member further including a receiving bore, a second cartridge container having a second body configured to contain a supply of the second fluid material and a second nozzle member coupled with the second body and having a second nozzle channel configured to communicate with the supply of the second fluid material, the second nozzle member further including a stem configured to fit within the receiving bore, and a latch formed in one of the first and second nozzle members and a receiver formed in the other of the first and second nozzle members, the first cartridge container and the second cartridge container being positionable with respect to one another such that the first nozzle member and the second nozzle member cooperate with the stem of the second nozzle member received in the receiving bore of the first nozzle member to form a cartridge outlet for dispensing the first and second fluid materials, the second cartridge container being positioned adjacent to the first cartridge container, the cartridge outlet including a first dispensing opening communicating with the first nozzle channel and a second dispensing opening communicating with the second nozzle channel, a threaded portion configured for threadably securing a mixing element to the cartridge outlet, and an uninterrupted sealing surface formed on the first nozzle member and surrounding the first and second dispensing openings, the sealing surface being situated between the threaded portion and the first and second dispensing openings and configured for sealing engagement with a mixing element when the mixing element is attached to the cartridge outlet, and the latch and the receiver cooperating to secure the first cartridge container with the second cartridge container when the first nozzle member and second nozzle member are positioned to form the cartridge outlet, wherein the threaded portion of the cartridge outlet is defined by a first threaded region on the first nozzle member and a second threaded region on the second nozzle member.

13. The side by side cartridge assembly of claim 12, wherein the entire threaded portion of the cartridge outlet is defined on the first nozzle member.

14. A method for joining a first cartridge container and a second cartridge container to form a side by side cartridge assembly for dispensing first and second fluid materials, the first cartridge container having a first body configured to contain a supply of the first fluid material and a first nozzle member coupled with the first body and having a first nozzle channel configured to communicate with the supply of the first fluid material and a receiving bore, and the second cartridge container having a second body configured to contain a supply of the second fluid material and a second nozzle member coupled with the second body and having a second nozzle channel configured to communicate with the supply of the second fluid material and a stem, the method comprising:

positioning the stem of the second nozzle member into the receiving bore of the first nozzle member, forming a cartridge outlet for dispensing the first and second fluid materials, the cartridge outlet including a first dispensing opening communicating with the first nozzle channel and a second dispensing opening communicating with the second nozzle channel, and an uninterrupted sealing surface surrounding the first and second dispensing openings and configured for sealing engagement with a mixing element when the mixing element is attached to the cartridge outlet, and securing the first cartridge container with the second cartridge container, wherein one of the first and second nozzle members includes a latch and the other of the first and second nozzle members includes a receiver, and wherein securing the first cartridge container with the second cartridge container includes engaging the latch with the receiver, wherein securing includes threading the mixing element onto a threaded portion of the cartridge outlet, and wherein the threaded portion of the cartridge outlet is defined by a first threaded region on the first nozzle member and a second threaded region on the second nozzle member, and threading the mixing element includes threading the mixing element onto the first nozzle member and the second nozzle member.

15. The method of claim 14, further comprising securing the mixing element to the cartridge outlet and forming a sealing engagement between a surface of the mixing element and the sealing surface of the cartridge outlet.

16. The method of claim 14, wherein the entire threaded portion of the cartridge outlet is defined on the first nozzle member, and threading the mixing element includes threading the mixing element onto the first nozzle member.

17. The method of claim 14, wherein the receiver is an undercut.

18. The method of claim 14, wherein the receiver is a protrusion.

19. The method of claim 14, wherein the first cartridge container and the second cartridge container extend between respective dispensing ends and back ends, the first and second nozzle members being located proximate the dispensing ends, and wherein securing includes securing the first cartridge container and the second cartridge container proximate the dispensing ends.

20. The method of claim 19, wherein securing further includes securing the first cartridge container and the second cartridge container proximate the back end.

* * * * *